US009402522B2

(12) United States Patent
Bassett et al.

(10) Patent No.: US 9,402,522 B2
(45) Date of Patent: Aug. 2, 2016

(54) CYCLONIC SEPARATION DEVICE

(71) Applicant: Hoover Limited, Merthyr Tydfil (GB)

(72) Inventors: Alexander Anthony Denny Bassett, Suzhou (CN); Qunli Zhao, Suzhou (CN); Xiaolong Bian, Nantong (CN)

(73) Assignee: Hoover Limited (GB)

( * ) Notice: Subject to any disclaimer, the term of this patent is extended or adjusted under 35 U.S.C. 154(b) by 0 days.

(21) Appl. No.: 14/644,072

(22) Filed: Mar. 10, 2015

(65) Prior Publication Data

US 2015/0257618 A1 Sep. 17, 2015

(30) Foreign Application Priority Data

Mar. 11, 2014 (GB) ..... 1404229.5

(51) Int. Cl.
*A47L 9/16* (2006.01)
*B04C 3/04* (2006.01)

(52) U.S. Cl.
CPC ..... *A47L 9/1641* (2013.01); *A47L 9/1625* (2013.01); *A47L 9/1675* (2013.01); *B04C 3/04* (2013.01)

(58) Field of Classification Search
CPC ... A47L 9/1608; A47L 9/1616; A47L 9/1641; A47L 9/1625; A47L 9/1675; B04C 3/04
See application file for complete search history.

(56) References Cited

U.S. PATENT DOCUMENTS 3,655,058 A * 4/1972 Novak ..... B04B 5/12 210/360.1
5,287,591 A * 2/1994 Rench ..... A47L 5/30 15/328
6,485,536 B1 * 11/2002 Masters ..... A47L 9/102 55/337
7,615,088 B2 * 11/2009 Benedictus ..... A47L 9/1608 55/337

* cited by examiner

*Primary Examiner* — Dung Van Nguyen
(74) *Attorney, Agent, or Firm* — Kang S. Lim

(57) ABSTRACT

A cyclonic separation device comprises a plurality of cyclonic separators fluidly arranged in parallel with each other, each cyclonic separator comprising a chamber 18 having a circular-section side wall 19, a fluid inlet 20 and a fluid outlet 21 disposed at one end of the cyclone chamber 18, and an opening at the second end of the cyclone chamber 18 through which separated matter passes out of the chamber for collection. The cyclonic separators are arranged in a rotatable body 17 such that their respective cyclone axes B are outwardly inclined relative to an axis A of rotation of the body 17 and such that the second end of each cyclone chamber 18 is disposed radially outwardly of its first end with respect to the axis A of rotation. A motor 15 rotates the body 17 about its axis A of rotation and so imparts a radially outward force on separated matter forced against the side wall 19 by the cyclonic action, the radial force serving to rapidly force the matter axially of the towards the opening. The separation efficiency is thereby improved by the radial force.

16 Claims, 1 Drawing Sheet

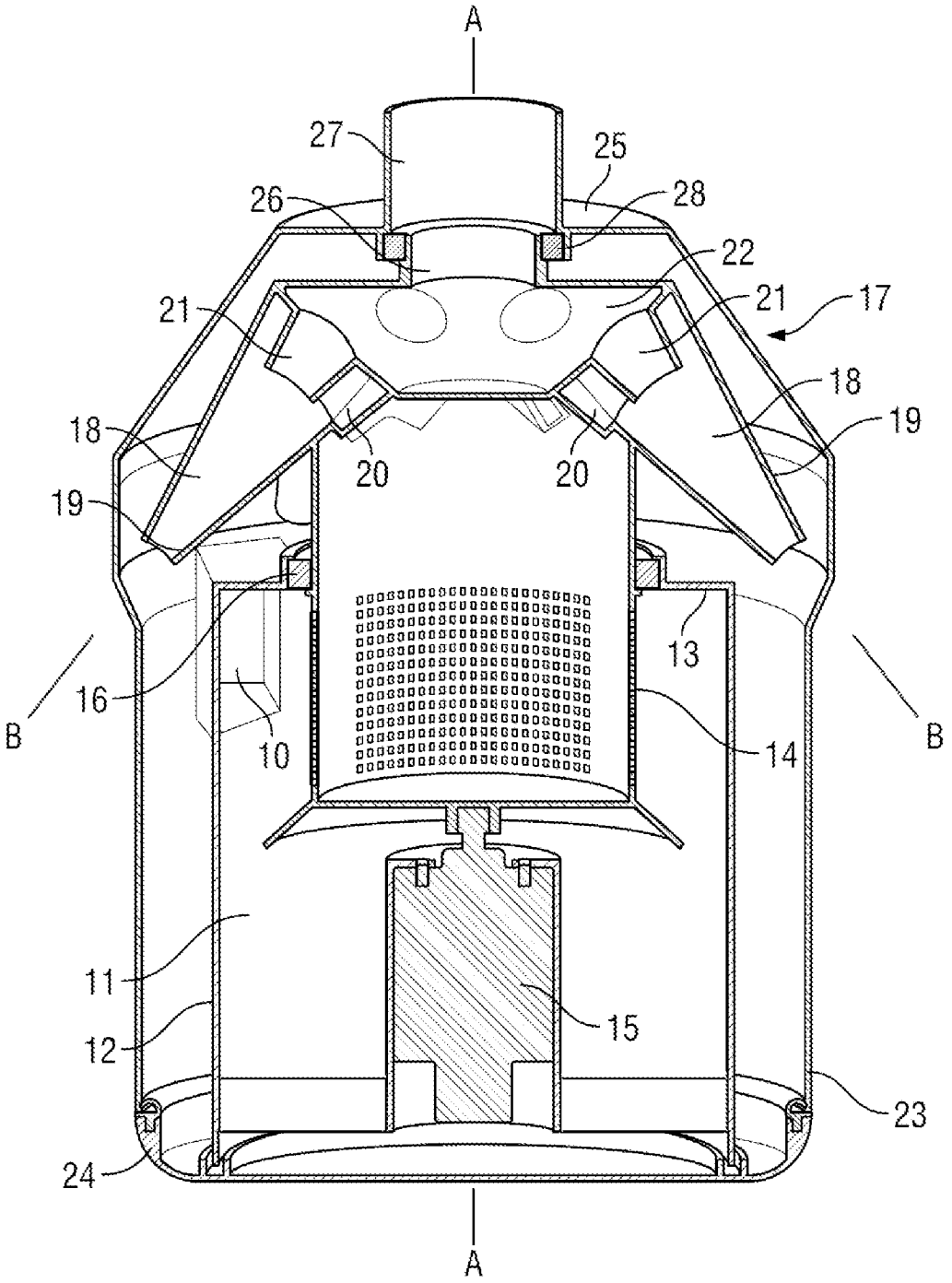
A
27
25
26
28
22
21
21
17
18
18
19
19
20
20
13
16
B
B
10
14
11
15
12
23
24
A

CYCLONIC SEPARATION DEVICE

CROSS REFERENCE TO RELATED APPLICATION

This application claims the benefit of United Kingdom Patent Application No. 1404229.5 filed Mar. 11, 2014, which application is incorporated herein in its entirety by this reference.

This application is also related to co-pending U.S. application Ser. No. 14/644,042, being filed concurrently herewith by the same inventors, of same title, which claims the benefit of United Kingdom Patent Application No. 1404237.8 filed Mar. 11, 2014, which applications are incorporated herein in their entirety by this reference.

BACKGROUND

This invention relates to a cyclonic separation device and more particularly but not solely to a cyclonic separation device for a vacuum cleaner.

Cyclonic separation devices are widely used in vacuum cleaners to separate dirt and dust from the airflow. Typically such vacuum cleaners incorporate a single upstream cyclonic separator which is relatively large in diameter and which is suited to separating heavy dirt and dust particles as well as coarse and fibrous matter from the airflow. Such large diameter cyclonic separators are unable to separate lighter dirt and dust particles and hence a further separation stage is needed downstream of the cyclonic separator.

It is well known to provide vacuum cleaners having a downstream stage which comprises a plurality of smaller diameter cyclonic separators connected fluidly in parallel with each other. Whilst smaller diameter cyclonic separators act to restrict airflow, the number of cyclonic separators is chosen so as not to impede the airflow due to the fact that each cyclonic separator takes a proportion of the airflow from the upstream device.

One such vacuum cleaner is disclosed in GB2490693 in which each cyclonic separator of the second stage comprises a cyclone chamber having a frusto-conical side wall. An air inlet is directed tangentially into the first and widest end of the chamber through the side wall thereof. An air outlet extends axially from an end wall which closes the first end of the cyclone chamber. The second end of the cyclone chamber is open. In some cyclonic separators, the side wall may be parallel or reverse-tapered, although cyclone chambers having a frusto-conical side wall are more suited to separating lighter dust particles.

In use, air enters the cyclone chamber through the inlet and rotates in a vertical manner around the cyclone axis inside the frusto-conical side wall towards the second end of the cyclone chamber. The dust particles in the rotating airflow are forced radially outwardly against the side wall under centrifugal action. The volume of rotating airflow slowly diminishes towards the second end of the cyclone chamber as air is drawn radially inwardly and axially towards the outlet at the first end of the cyclone chamber. However, the dust particles that are forced radially outwardly against the frusto-conical side wall are disposed in a boundary layer and slowly migrate towards the open second end of the cyclone chamber, whereupon they pass out of the cyclone chamber into a collection chamber.

A disadvantage of the above-mentioned arrangement is that dust particles in the boundary layer can become re-entrained in the airflow, particularly if the airflow is heavily laden with dust or if there is a drop in airflow. Also, the speed at which the dust particles migrate is slow and hence the risk of re-entrainment is increased, partly because the volume of dust in the boundary layer is so great that it forms a layer which is too wide to remain inside the boundary layer.

Clearly the separation efficiency can be improved by using a high powered motor to drive the fan, which causes a higher rate of airflow through the cleaner. However, legislation is being introduced which limits the power that vacuum cleaners can consume with the result that the separation efficiency will be detrimental.

We have now devised a cyclonic separation device having an improved efficiency.

SUMMARY

In accordance with the present invention there is provided a cyclonic separation device comprising a plurality of cyclonic separators fluidly arranged in parallel with each other, each cyclonic separator comprising a chamber having a circular-section side wall, a fluid inlet and a fluid outlet disposed at one end of the cyclone chamber, and an opening at the second end of the cyclone chamber through which separated matter passes out of the chamber for collection, said cyclonic separators being arranged in a rotatable body such that their respective cyclone axes are outwardly inclined relative to an axis of rotation of the body and such that the second end of each cyclone chamber is disposed radially outwardly of its first end with respect to said axis of rotation, the device further comprising a motor for rotating the body about its axis of rotation.

In use, the body is rotated and the cyclonic separators operate as hereinbefore described. However, the rotation of the body about its axis of rotation applies additional forces to the dust particles in the cyclone chamber, which act to force the dust particles radially outwardly of the axis of rotation of the body and hence axially of the inclined cyclone chamber towards the opening at the second end thereof. In this manner the separation efficiency is improved because the additional force acts to increase the speed at which the dust particles in the boundary layer migrate towards the outlet.

When utilized in a vacuum cleaner, a cyclonic separation device in accordance with the present invention enables a lower power motor to be used without detrimenting the separation efficiency.

The longitudinal cyclone axis of each cyclonic separator may extend substantially radially of the axis of rotation of the body (i.e., at substantially 90° thereto) or it may lie at an angle of preferably greater than 30° to the axis of rotation.

Preferably each cyclonic separator comprises a frusto-conical side wall.

Preferably the body comprises at least four cyclonic separators arranged fluidly in parallel.

Preferably the cyclonic separators are equally spaced circumferentially around the body.

Preferably the body is disposed inside a housing defining a collection chamber for separated matter.

Preferably the collection chamber comprises an annular wall which extends around the body in front of the outlets of the cyclone chambers.

Preferably the motor is arranged to rotate the body at rotational speeds of 1500-5000 rpm. The motor may be also arranged to drive a fan which creates the airflow through the device.

Preferably the cyclonic separators in the body form a downstream separation stage of the device, the device further comprising an upstream separation stage. The upstream stage may comprise a single cyclonic separator or a plurality of cyclonic separators fluidly connected in series and/or parallel.

Preferably the upstream stage comprises a cyclonic separator having a cyclone axis which co-extends with the axis of rotation of the body.

Preferably the cyclonic separator of the upstream stage comprises a fluid outlet at one end which connects to a fluid inlet of the second stage, a cylindrical shroud being disposed around the outlet inside a cyclone chamber of the cyclonic separator of the first stage, the longitudinal axis of the shroud co-extending with the axis of rotation of the body.

A problem with such shrouds is that the apertures therein can become blocked with dirt and dust. Another problem is that the rotational airflow inside the cyclone chamber of the first stage has to decelerate and turn radially inwardly to pass through the apertures, thereby causing a pressure drop.

In order to solve the above-mentioned problems, co-pending UK patent application no. 1404237.8 filed Mar. 11, 2014, discloses a cyclonic separation device having a shroud which is rotated at or near the rotational airflow speed inside the cyclonic separator in which it is provided. Therefore, the shroud is preferably also rotated by said motor.

The motor can be positioned inside the shroud or outside the shroud, for example in a dust collection receptacle of the device. In the former case, providing the motor within the shroud increases the capacity of the dust collection receptacle of the device and reduces the noise emanating from the motor.

Preferably the above-mentioned collection chamber comprises a portion which extends around the cyclone chamber of said first stage.

Preferably the shroud and body form a unitary member.

Preferably the shroud extends through an end wall of the cyclone chamber of the first separation stage, a seal preferably being provided for sealing the end wall of the chamber to the shroud.

Also in accordance with the present invention, there is provided a vacuum cleaner having a cyclonic separation device as hereinbefore defined.

BRIEF DESCRIPTION OF THE DRAWINGS

An embodiment of the present invention will now be described by way of an example only and with reference to the accompanying drawing, the single FIGURE of which is a sectional view through a cyclonic separation device of a vacuum cleaner in accordance with the present invention.

DETAILED DESCRIPTION

Aspects, features and advantages of exemplary embodiments of the present invention will become better understood with regard to the following description in connection with the accompanying drawing(s). It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. Hence, use of absolute terms, such as, for example, "will," "will not," "shall," "shall not," "must," and "must not," are not meant to limit the scope of the present invention as the embodiments disclosed herein are merely exemplary.

Referring to the drawing, the cyclonic separation device comprises an air inlet 10 which leads tangentially into the upper end of a cyclone chamber 11 of a first separation stage through a cylindrical side wall 12 thereof The upper end of the cyclone chamber 11 is closed by an end wall 13 which defines a circular air outlet of the first stage.

A cylindrical shroud 14 is mounted concentrically inside the cyclone chamber 11 at the upper end thereof The shroud 14 comprises a bottom wall which is supported on the shaft of a motor 15 disposed at the bottom of the cyclone chamber 11. The shroud 14 extends upwardly through the circular air outlet in the end wall 13 and is rotationally sealed thereto by an annular seal 16.

The lower end of the shroud 14 comprises a plurality of apertures which fluidly communicate the interior of the cyclone chamber 11 with the interior of the shroud 14. The upper end of the shroud 14 is rigidly connected to the body 17 of a second separation stage. The body 17 comprises six outwardly-inclined cyclonic separators which are circumferentially arranged about an axis A of rotation of the shroud 14 and body 17. Each cyclonic separator comprises a cyclone chamber 18 having a cyclone axis B which extends radially outwardly of the rotational axis A.

Each cyclone chamber 18 is defined by a frusto-conical side wall 19 which tapers inwardly towards its radially outer end, the latter being open to define a dust outlet of the cyclone chamber 18.

The radially inner end of each cyclone chamber 18 comprises an inlet 20 which extends tangentially through its frusto-conical side wall 19. The inlets 20 communicate directly with the interior of the upper end of the shroud 14. The combined cross-sectional area of the inlets 20 is substantially equal to the cross-sectional area of the inlet 10 of the first separation stage.

The radially inner end of each cyclone chamber 18 also comprises a tubular outlet or so-called vortex finder 21 which extends axially of the cyclone chamber 18 from its inner end wall. The vortex finders 21 lead into a manifold chamber 22 at the upper end of the body 17.

The first and second separation stages are enclosed within a housing having a tubular side wall 23, an openable bottom wall 24 and a top wall 25. A tubular air outlet 26 extends axially upwardly from the manifold 22 to a tubular duct 27 provided on the upper surface of the top wall 25, the outlet 26 being rotationally journalled thereto by an annular seal 28.

In use, a negative pressure is applied to the outlet duct 27 by a motor and fan unit (not shown) disposed downstream thereof. The motor 15 is actuated to cause the shroud 14 and body 17 to rotate about the axis A at a rotational speed of between 1500 and 5000 rpm. The negative pressure draws dirt and dust laden air tangentially into the cyclone chamber 11 through the inlet 10 from a cleaning head of the cleaner. The motor 15 is arranged to rotate the shroud 14 and body 17 in the same direction as the air flows around the shroud 14 inside the cyclone chamber 11. The dirt and dust particles in the rotating airflow are forced radially outwardly against the side wall 12 of the cyclone chamber 11 under centrifugal action. The negative pressure draws the rotating airflow radially inwardly through the apertures in the shroud 14. However, since the shroud 14 is rotating at or near the rotational speed of the airflow, the air does not need to decelerate to pass through the apertures into the interior of the shroud 14. Any dirt and dust particles that accumulate on the exterior of the shroud 14 are thrown radially outwardly under centrifugal action and therefore the risk of blockage of the apertures is avoided.

The diameter of the cyclone chamber 11 is such that the airflow leaving the cyclone chamber is not fully cleaned and hence lighter dust particles pass through the apertures into the interior of the shroud 14.

The dirt and dust particles that are forced against the tubular side wall 12 of the cyclone chamber 11 slowly migrate downwardly in a boundary layer towards the bottom end of the cyclone chamber 11, whereupon they accumulate for collection.

The air entering the shroud 14 flows axially upwardly to the bottom wall of the body 17 where it is equally divided and flows tangentially into a respective cyclone chambers 18 through the inlets 20 thereof. The air inside each cyclone chamber 18 flows around the frusto-conical side wall 19 thereof towards the radially outer end of the cyclone chamber 18. The lighter dust particles in the rotating airflow are forced radially outwardly against the side wall 19 under centrifugal action. The volume of rotating airflow slowly diminishes towards the radially outer end of the cyclone chamber 18 as air is drawn inwardly and axially towards the vortex finder 21. However, the dust particles that are forced outwardly against the frusto-conical side wall move in a boundary layer towards the radially outer open end of the cyclone chamber 18. It will be appreciated that the dust particles in the boundary layer are rapidly forced radially outwardly along the cyclone axis B by virtue of the centrifugal action of the rotating body 17.

Dust particles leaving the cyclone chamber 18 are thrown radially outwardly against the tubular side wall 23 of the housing, whereupon they fall downwardly towards the bottom of the device. The bottom wall 24 can be removed to allow the separated dirt and dust particles to be removed from both the first and second stages of the device.

A vacuum cleaner in accordance with the present invention has a greatly improved separation efficiency compared with vacuum cleaners of the kind disclosed in GB2490693 even when the overall power consumption of the vacuum cleaner is reduced to comply with legislation.

While the preferred embodiment of the invention has been shown and described, it will be understood by those skilled in the art that changes of modifications may be made thereto without departing from the true spirit and scope of the invention.

What is claimed is:

1. A cyclonic separation device comprising a plurality of cyclonic separators fluidly arranged in parallel with each other, each cyclonic separator comprising a chamber having a circular-section side wall, a fluid inlet and a fluid outlet disposed at one end of the cyclone chamber, and an opening at the second end of the cyclone chamber through which separated matter passes out of the chamber for collection, said cyclonic separators being arranged in a rotatable body such that their respective cyclone axes are outwardly inclined relative to an axis of rotation of the body and such that the second end of each cyclone chamber is disposed radially outwardly of its first end with respect to said axis of rotation, the device further comprising a motor for rotating the body about its axis of rotation.

2. A cyclonic separation device as claimed in claim 1, in which the cyclone axis of each cyclonic separator extends substantially radially of the axis of rotation of the body.

3. A cyclonic separation device as claimed in claim 1, in which the cyclone axis of each cyclonic separator extends at an angle of greater than 30° to the axis of rotation of the body.

4. A cyclonic separation device as claimed in claim 1, in which each cyclonic separator comprises a frusto-conical side wall.

5. A cyclonic separation device as claimed in claim 1, in which the body comprises at least four cyclonic separators arranged fluidly in parallel.

6. A cyclonic separation device as claimed in claim 1, in which the cyclonic separators are equally spaced circumferentially of the body.

7. A cyclonic separation device as claimed in claim 1, in which the body is disposed inside a housing defining a collection chamber for separated matter.

8. A cyclonic separation device as claimed in claim 7, in which the collection chamber comprises an annular wall which extends around the body in front of the outlets of the cyclone chambers.

9. A cyclonic separation device as claimed in claim 1, in which the motor is arranged to rotate the body at rotational speeds of 1500-5000 rpm.

10. A cyclonic separation device as claimed in claim 1, in which the motor is arranged to drive a fan which creates the airflow through the device.

11. A cyclonic separation device as claimed in claim 1, in which the cyclonic separators in the body form a downstream separation stage of the device, the device further comprising an upstream separation stage having a cyclonic separator having a cyclone axis which co-extends with the axis of rotation of the body.

12. A cyclonic separation device as claimed in claim 11, in which the cyclonic separator of the upstream stage comprises a fluid outlet at one end which connects to a fluid inlet of the second stage, a cylindrical shroud being disposed around the outlet inside a cyclone chamber of the cyclonic separator of the first stage, the longitudinal axis of the shroud co-extending with the axis of rotation of the body.

13. A cyclonic separation device as claimed in claim 12, in which the shroud is rotated by said motor.

14. A cyclonic separation device as claimed in claim 13, in which the shroud and body form a unitary member.

15. A cyclonic separation device as claimed in claim 13, in which the shroud extends through an end wall of the cyclone chamber of the first separation stage, a seal being provided for sealing the end wall of the chamber to the shroud.

16. A vacuum cleaner having a cyclonic separation device as claimed in claim 1.

* * * * *